US006715530B2

(12) United States Patent
Goldsmith et al.

(10) Patent No.: US 6,715,530 B2
(45) Date of Patent: Apr. 6, 2004

(54) LATCH ASSEMBLY SYSTEM FOR OPERABLE WALL PANELS

(75) Inventors: Thomas Goldsmith, Earlville, IA (US); Jeff Kronlage, Dyersville, IA (US); Steve Helbing, Dubuque, IA (US)

(73) Assignee: Modernfold, Inc., New Castle, IN (US)

( * ) Notice: Subject to any disclaimer, the term of this patent is extended or adjusted under 35 U.S.C. 154(b) by 0 days.

(21) Appl. No.: 10/109,613

(22) Filed: Mar. 28, 2002

(65) Prior Publication Data

US 2003/0183350 A1 Oct. 2, 2003

(51) Int. Cl.[7] ..... E05D 15/26
(52) U.S. Cl. ..... 160/199; 52/243.1; 292/128
(58) Field of Search ..... 160/199, 196.1, 160/200; 52/243.1; 49/127; 16/65, 92, 101, 104, DIG. 10, DIG. 17, DIG. 31, 97; 292/129, 124, 128, 159, 179, 150, 170, 175, 174

(56) References Cited

U.S. PATENT DOCUMENTS 1,420,087 A * 6/1922 Frantz ..... 160/199
1,571,194 A * 2/1926 Frantz ..... 160/199
1,594,165 A * 7/1926 Frantz ..... 160/192
1,783,378 A * 12/1930 Ferris ..... 160/200
4,159,556 A 7/1979 Dickson
4,401,033 A 8/1983 Gerken
4,569,164 A 2/1986 Dickson
4,642,947 A 2/1987 Dickson
4,752,987 A 6/1988 Dreyer et al.
4,837,891 A 6/1989 Toma et al.
5,016,318 A 5/1991 Harris
5,152,332 A 10/1992 Siener
5,219,191 A * 6/1993 Wolter ..... 292/157
5,499,671 A 3/1996 Owens
5,544,462 A 8/1996 Kordes
6,098,695 A 8/2000 Schwingle
6,516,575 B2 * 2/2003 Haab et al. ..... 52/243.1

* cited by examiner

*Primary Examiner*—Blair M. Johnson
(74) *Attorney, Agent, or Firm*—Baker & Daniels

(57) ABSTRACT

The present invention involves a latch mechanism and method that prevents the leading operable wall panel of an operable wall panel system from moving out of alignment with the track of a track and trolley system as the lead operable wall panel unfolds and extends from a stacked orientation to a straightened orientation. The latch mechanism includes a catch member to catch a latch pin depending down from the trolley of the track and trolley system. When the catch member catches the latch pin, a resilient biasing member of the latch mechanism operates to lock the latch mechanism about the latch pin. As a result, the lead operable wall panel is locked into a straightened orientation.

10 Claims, 8 Drawing Sheets

LATCH ASSEMBLY SYSTEM FOR OPERABLE WALL PANELS

BACKGROUND OF THE INVENTION

1. Field of the Invention

The field of the present invention pertains to operable wall systems that are used to partition large rooms into smaller rooms.

2. Description of the Related Art

Operable wall systems, also known as movable wall panel systems, find useful application in a variety of venues, such as classrooms, offices, convention centers, hospitals, etc. In these venues, operable wall systems can be utilized to efficiently divide or compartmentalize interior space into a multitude of separate, smaller rooms. In particular, the operable wall panels are typically connected to trolleys that roll within an overhead track, and travel of the trolleys within the track allows the panels to be moved between a stacked orientation in a storage location, and a straightened orientation in alignment with the overhead track.

One type of operable wall system is a continuously-hinged panel system in which each operable wall panel is typically hinged to its adjacent panels. Continuously-hinged panel systems are frequently electrically driven between a stacked orientation and a straightened orientation. One problem with continuously-hinged panels is that during panel movement, the leading operable wall panel has a tendency to move out of alignment with the overhead track as it unfolds and extends from its stacked orientation to its straightened orientation. As the leading operable wall panel waivers during unfolding and extension, it causes the rest of the continuously-hinged panels to either drift out or extend in an unaligned fashion. This movement is undesirable as these unaligned panels can eventually jam and hinder further wall extension.

For the above-mentioned reasons, there is a need for an apparatus that prevents the leading operable wall panel from moving out of alignment as it unfolds and extends from its stacked orientation to its straightened orientation.

SUMMARY OF THE INVENTION

The present invention aligns the leading operable wall panel of a continuously-hinged panel system with the track of a track and trolley system as the system unfolds and extends from its stacked orientation to its straightened orientation. The present invention provides a latch mechanism that secures the lead operable wall panel to the lead trolley of a track and trolley system, thereby preventing the rest of the hinged panels from extending in an unaligned orientation.

The latch mechanism of the present invention is used in combination with a continuously-hinged panel system operating within a track and trolley system. In certain embodiments, the lead trolley includes a latch pin that extends downward from the trolley and through a slot in the track. The latch mechanism is attached to the top edge of the lead operable wall panel of the continuously-hinged panel system and includes a catch member configured to receive the latch pin depending down from the lead trolley. When the operable wall panels begin to extend and the lead operable wall panel swings open, the latch mechanism catches the latch pin and locks the lead operable wall panel in a straight orientation, solidly aligned with the track.

In one embodiment of the present invention, the latch assembly system includes a track and a trolley system. The lead trolley moves within the track and includes a latch pin that extends downward from the lead trolley through the track. A lead operable wall panel of the continuously-hinged panel system is connected to and carried by the lead trolley. A pivot member is pivotally coupled to the lead trolley and the lead operable wall panel pivotally moves about the pivot member. The latch assembly system also includes a latch mechanism which is attached to the top edge of the lead operable wall panel. In another embodiment, the latch mechanism is attached to the top edge of an operable wall panel that is not the lead operable wall panel.

The latch mechanism includes a catch member for catching the latch pin depending down from the lead trolley. The catch member is configured to engage the latch pin. The catch member includes a cam surface for engaging the latch pin, a stop face for stopping the engagement of the latch pin, and a latch pin seat for maintaining the latch pin within the catch member. In one aspect of the invention, the latch mechanism further includes a biasing assembly for maintaining the catch member against the latch pin and locking the operable wall panel into alignment with the track. In one form, the biasing assembly includes a resilient biasing member, an elongated shaft extending through the resilient biasing member, and a pin member extending downward through the shaft for operating against the resilient biasing member. When the catch member catches the latch pin depending down from the lead trolley, the pin member operates against the resilient biasing member to keep the resilient biasing member biased and the latch mechanism locked about the latch pin. In a specific embodiment, the resilient biasing member includes a spring disposed about the shaft between two bracket members. The spring can be a compression spring.

The manner in which the latch mechanism secures the latch pin enables the continuously-hinged panels to move between a stacked orientation in a storage location to a straightened orientation in alignment with the overhead track. Once the latch pin is secured within the latch mechanism, the lead operable wall panel does not waiver.

Because the operable wall panels do not jam as they extend in alignment with the overhead track, the panels are likely to last longer in their optimal condition. Other objects of the invention will become apparent upon consideration of the following written description and accompanying figures.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
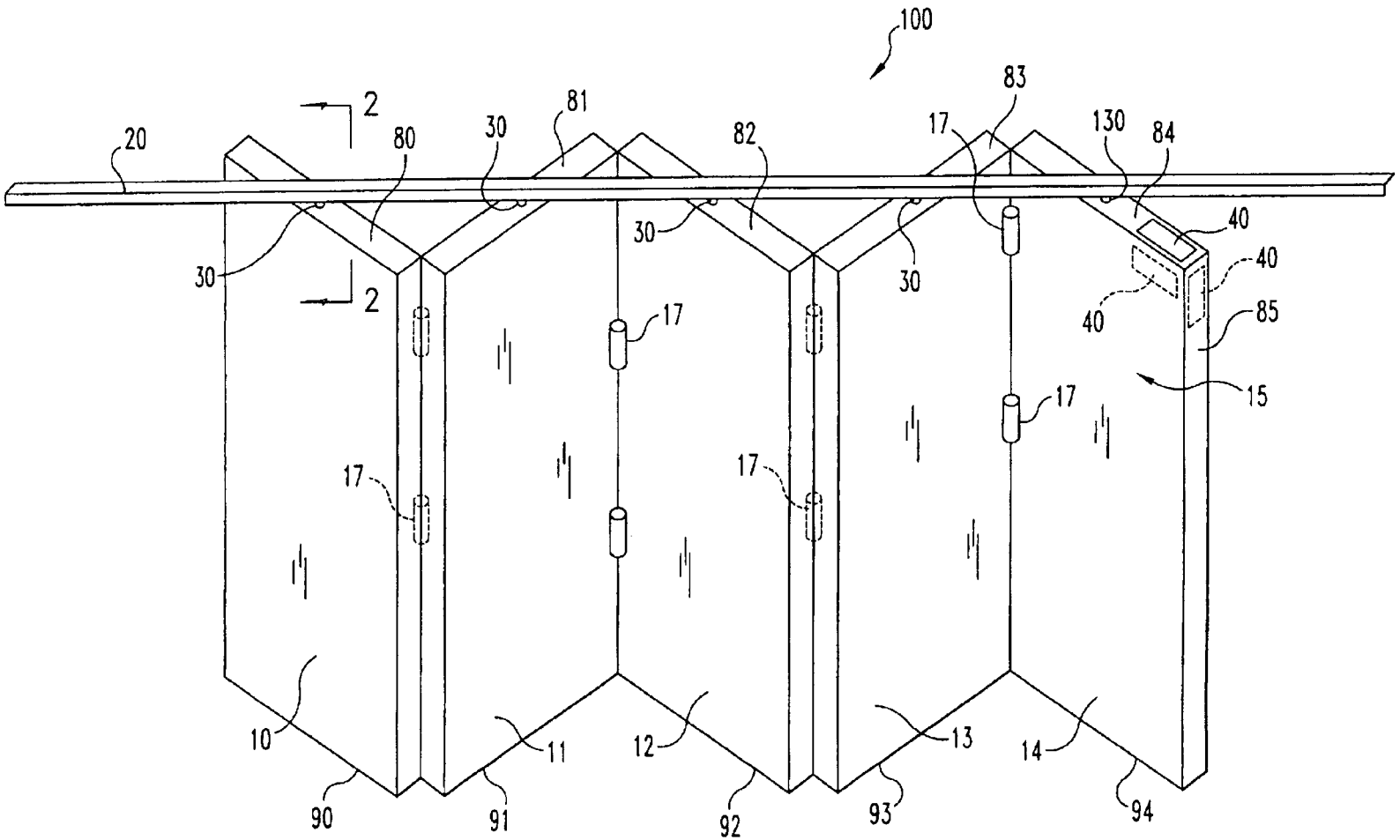
FIG. 1 is a diagrammatic perspective view of an operable wall system with which the various embodiments of the latch assembly system described herein may be employed.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE INVENTION

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

FIG. 1 shows an operable wall system which may be equipped with latch assembly system 140 (shown in FIG. 5) of the present invention. Operable wall system 100 is shown as a continuously-hinged panel system and includes operable wall panels 10, 11, 12, 13 suspended from track 20 by trolleys 30. Lead operable wall panel 14 is suspended from track 20 by lead trolley 130. Operable wall panels 10, 11, 12, 13 and lead operable wall panel 14 include top edges 80, 81, 82, 83 and 84 and bottom edges 90, 91, 92, 93 and 94. Lead operable wall panel 14 also includes front edge 85 and front side 15. The term "trolley" encompasses devices, including wheeled carriages and carriers of all types, that are operably connected to and movable along track 20. The term "lead trolley" refers to the front-most trolley of multiple trolleys operably connected to and movable along track 20. The term "lead operable wall panel" refers to the front-most operable wall panel in any operable wall system which includes multiple hinged-panels. Operable wall panel 10 is linked to operable wall panel 11, operable wall panel 11 is linked to operable wall panel 12, operable wall panel 12 is linked to operable wall panel 13, and operable wall panel 13 is linked to lead operable wall panel 14. Operable wall panels 10–14 are linked by multiple hinges 17 arranged along the panel height. Track 20 is mountable to a support structure above the room. Operable wall panels 10, 11, 12, 13, and lead operable wall panel 14 may be moved along track 20 in wall stacking and wall extending directions. Operable wall panels 10, 11, 12, 13, and lead operable wall panel 14 may be of any conventional design which are compatible with track 20, trolleys 30 and 130, and latch mechanism 40 of the present invention. Furthermore, although shown as being employed with a continuously-hinged panel system, latch assembly system 140 (shown in FIG. 5) described herein may be both employed with different types of operable wall systems, including paired panel systems, single panel systems, and employed with linear or non-linear track configurations.

Figure 2:
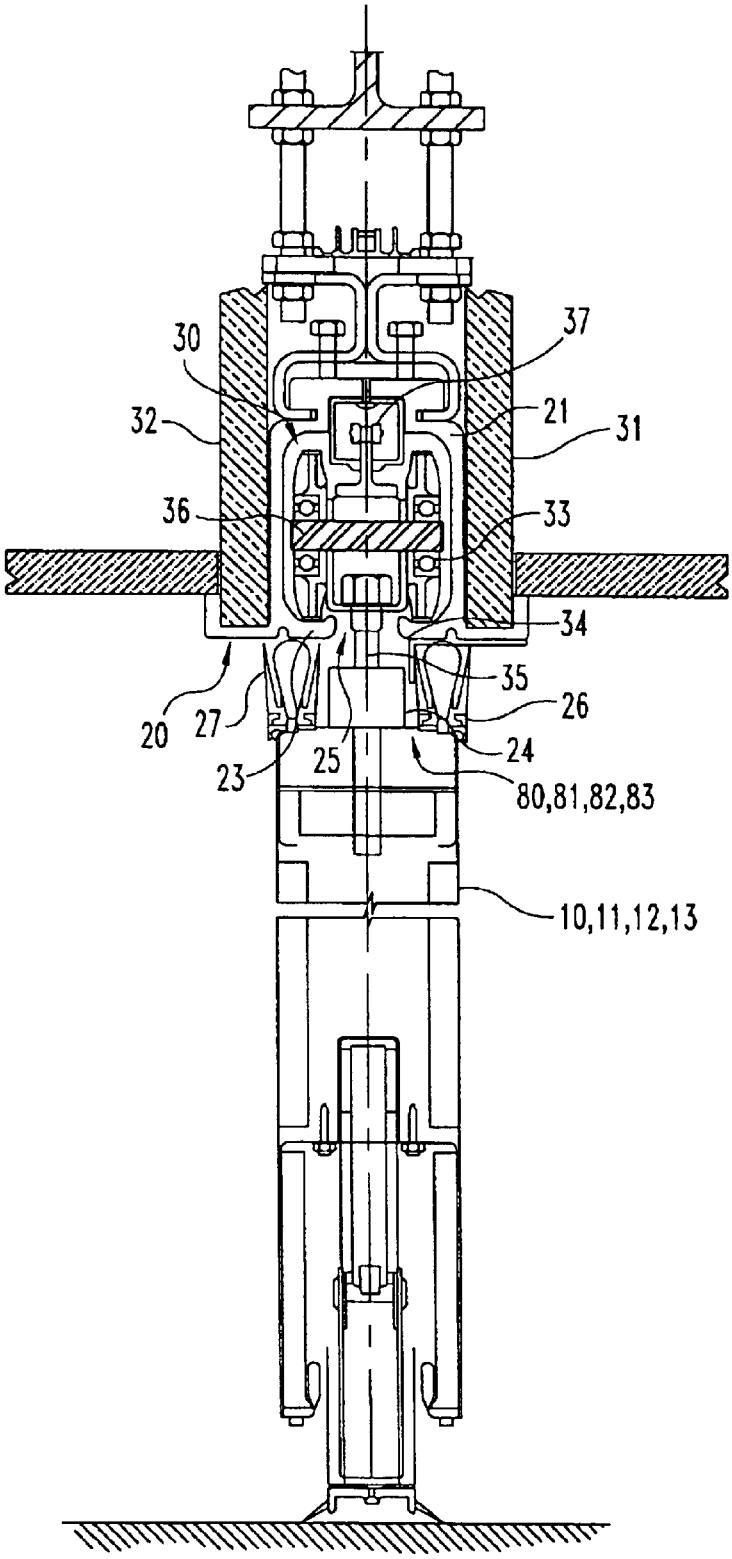
FIG. 2 is a cross-sectional view of a track and trolley assembly taken from line 2—2 in FIG. 1 as viewed in the direction of the arrows.

FIG. 2 shows in detail the components of one track and trolley system that can be used in conjunction with the operable wall system of FIG. 1. In this particular embodiment, track 20 includes housing 21 and carrier rails 23, 24. Rails 23, 24 form the bottom-most portions of housing 21. Trolley 30 includes discs 31, 32, pivot member frame 33, pivot member 35, and disc coupling 36. Pivot member frame 33 includes pivot member frame base 34. In a typical application, pivot member 35 is a pendant bolt. Disc coupling 36 is connected at one end to disc 31 and at the opposite end to disc 32. Operable wall panel 10, 11, 12, 13, includes top seals 26, 27, which are fixed upon top edge 80, 81, 82, 83 of operable wall panel 10, 11, 12, 13.

With reference still to FIG. 2, housing 21 envelops trolley 30. Disc coupling 36 is connected at one end to disc 31, extends through pivot member frame 33, and is connected at the opposite end to disc 32. Discs 31, 32 abut track 20 at rails 23, 24 and traverse track 20 along rails 23, 24. Pivot member 35 is pivotally coupled to trolley 30 at pivot member frame base 34. Pivot member 35 depends downward through space 25 in track 20, between top seals 26, 27, and attaches to operable wall panel 10, 11, 12, 13. Chain drive 37 is attached to trolley 30.

Figure 3:
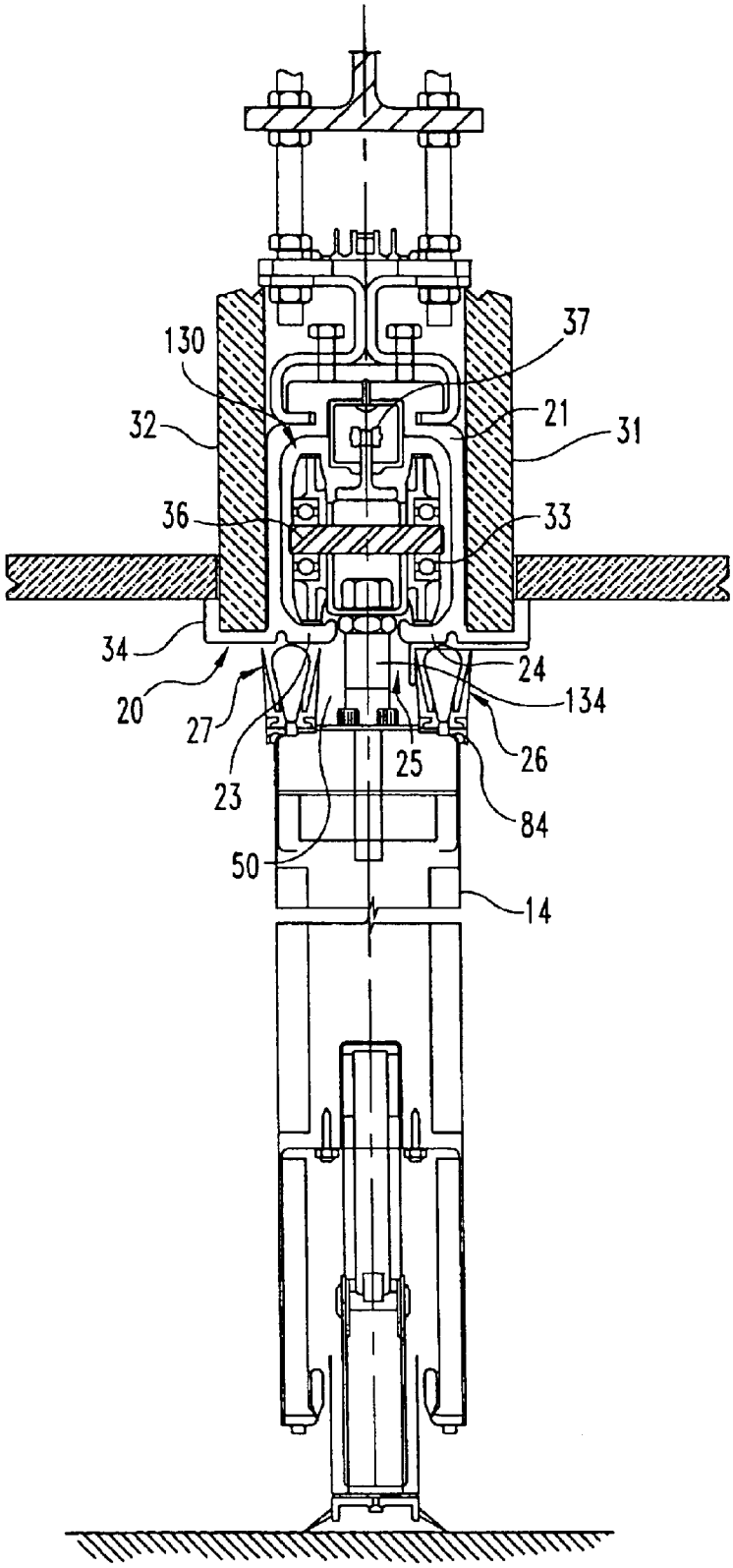
FIG. 3 is a cross-sectional view of a track and trolley system incorporating the latch assembly system of the present invention.

One embodiment of a track and trolley system incorporating the latch mechanism of the present invention is shown in FIG. 3. Track 20 includes housing 21 and carrier rails 23, 24. Rails 23, 24 form the bottom-most portions of housing 21. Lead trolley 130 includes discs 31, 32, pivot member frame 33, pivot member 35, disc coupling 36, and latch pin 134. Pivot member frame 33 includes pivot member frame base 34. In a typical application, pivot member 35 is a pendant bolt. Disc coupling 36 is connected at one end to disc 31, extends through pivot member frame 33, and is connected at the opposite end to disc 32. Lead operable wall panel 14 includes top seals 26, 27, which are fixed upon top edge 84 of lead operable wall panel 14.

Figure 5:
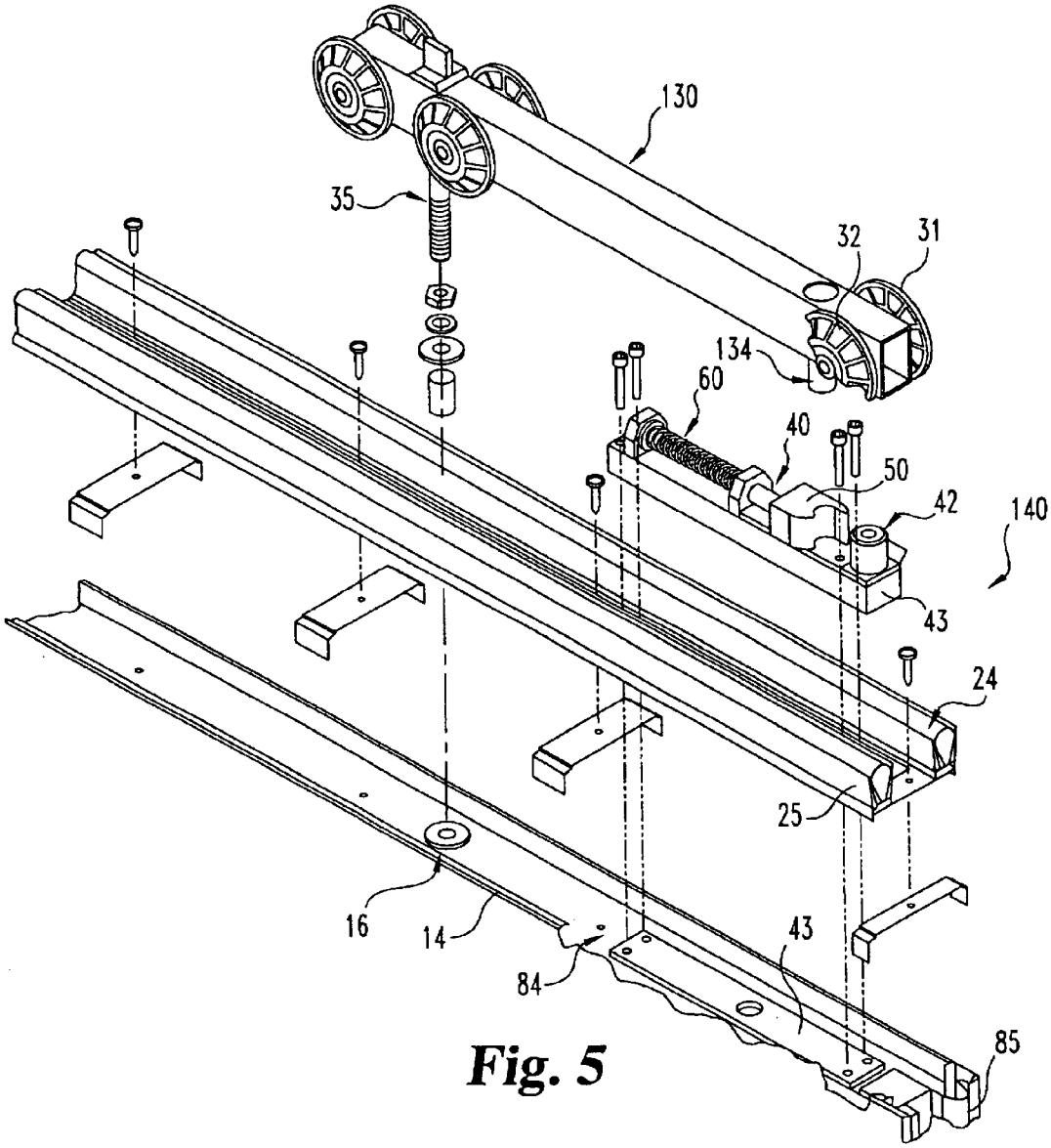
FIG. 5 is an exploded view of a latch mechanism system according to one embodiment of the present invention.

With reference still to FIG. 3, housing 21 envelops lead trolley 130. Disc coupling 36, attached to disc 31 at one end, extends through pivot member frame 33 and attaches to disc 32 at the opposite end thereof. Discs 31, 32 abut track 20 at rails 23, 24 and traverse track 20 along rails 23, 24. Latch pin 134 is bolted to a forward end of lead trolley 130 at pivot member frame base 34 and extends downward therefrom. As shown in FIG. 5, the term "forward end" of lead trolley 130 refers to the end of lead trolley 130 opposite the end where pivot member 35 is coupled. Catch member 50 of latch mechanism 40 (shown in FIG. 7), located between top seals 26, 27, is attached adjacent to top edge 84 of lead operable wall panel 14. Catch member 50 is configured to receive latch pin 134 when lead operable wall panel 14 pivots into alignment with lead trolley 130. Pivot member 35 (not seen in FIG. 3, but shown in FIG. 5) of lead trolley 130 is pivotally coupled to lead trolley 130 at pivot member frame base 34 and extends downward through space 25 in track 20, between top seals 26, 27, and attaches to lead operable wall panel 14. Chain drive 37 is attached to lead trolley 130.

Figure 4:
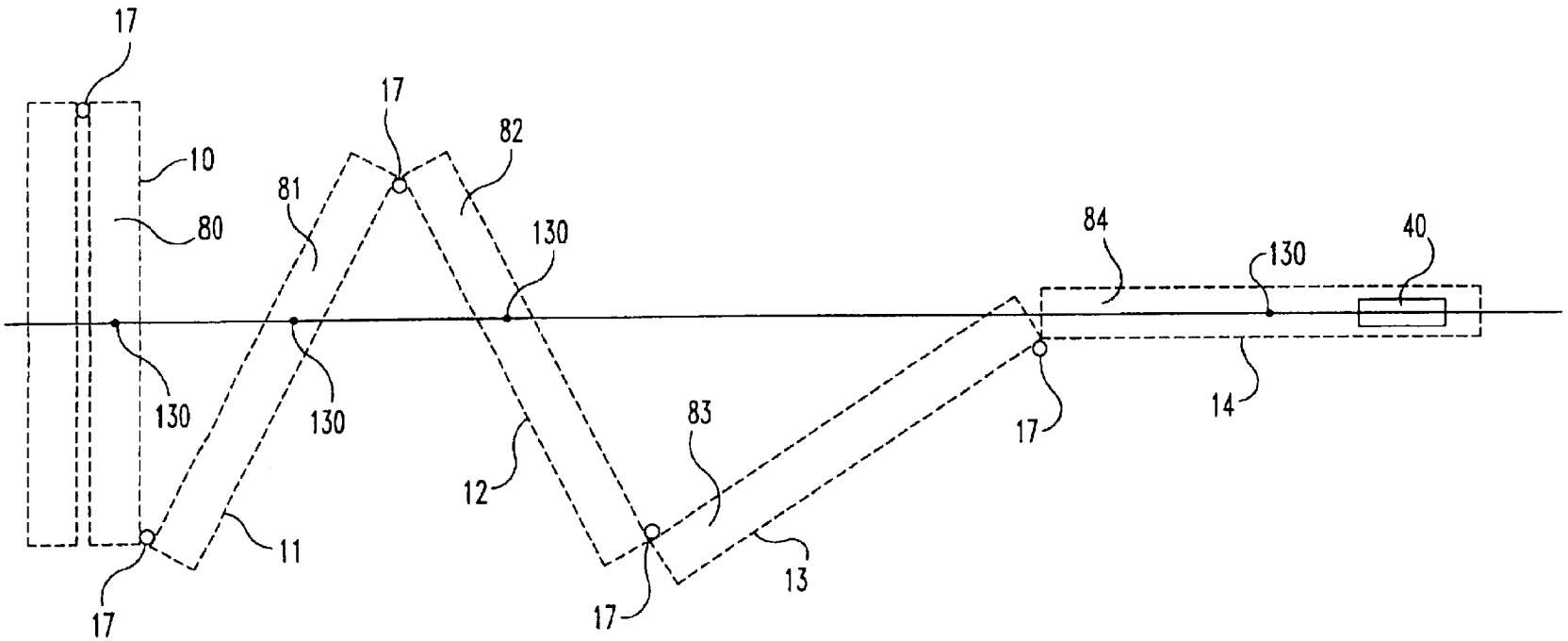
FIG. 4 is a diagrammatic top view of the operable wall system of FIG. 1, wherein the stacked position of the operable wall panels, which are shown being extended, is illustrated in dashed lines.

With reference to FIG. 4, where track 20 is abstractly represented by its centerline, one embodiment of latch assembly system 140 (shown in FIG. 5) of the present invention includes a continuously-hinged panel system, represented by operable wall panel 13 and leading operable wall panel 14 hinged thereto with multiple hinges 17. As continuously-hinged panels 13, 14 carried by trolley 30 and lead trolley 130 unfold from their stacked orientation (shown by the solid lines) to their straightened orientation (shown by the dashed-lines), latch mechanism 40, which is attached adjacent to top edge 84 of lead operable wall panel 14, operates to align lead operable wall panel 14 with track 20 by securing it to lead trolley 130. This prevents continuously-hinged panels 13, 14 from extending in an unaligned orientation, which would tend to cause continuously-hinged panels 13, 14 to jam during their extension from their stacked orientation.

Figure 6:
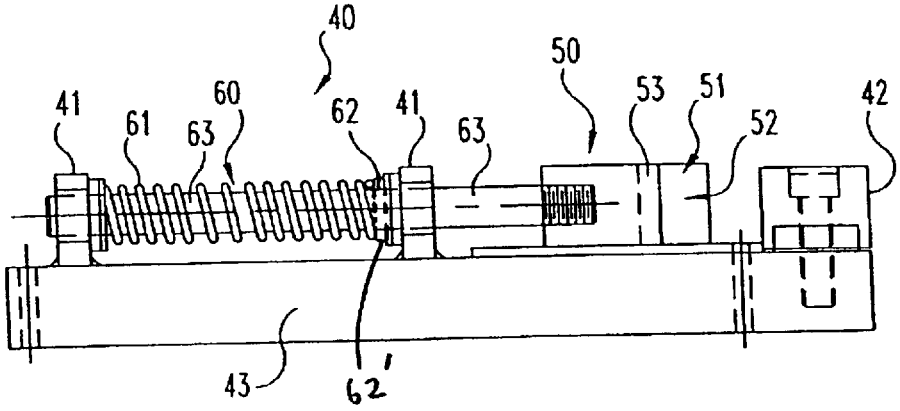
FIG. 6 is a side elevational view of the latch mechanism for the system shown in FIG. 5.
Figure 7:
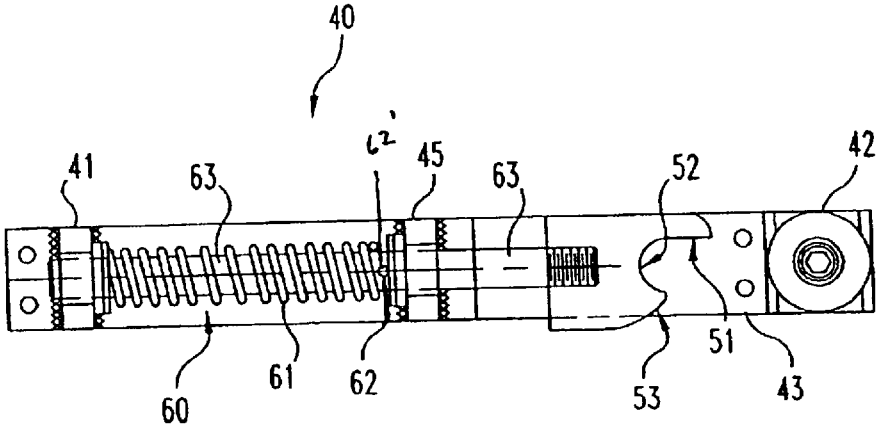
FIG. 7 is a top elevational view of the latch mechanism for the system shown in FIG. 5.

The latch mechanism of the present invention is shown in FIGS. 6 and 7. Latch mechanism 40 includes catch member 50, biasing assembly 60, base member 43, and bracket members 41. When lead operable wall panel 14 (of FIG. 8) pivots into alignment with lead trolley 130, catch member 50 catches latch pin 134. Cam surface 53 engages latch pin 134 into latch pin seat 52 of catch member 50. Stop face 51 stops the engagement of latch pin 134, and latch pin seat 52 is configured to fit about latch pin 134. In this way, latch pin 134 is maintained within catch member 50.

Biasing assembly 60 of latch mechanism 40 includes resilient biasing member 61, elongated shaft 63, and pin member 62. Bracket members 41 are mounted to base member 43 and act to guide shaft 63 when it is displaced. As lead operable wall panel 14 pivots into alignment with lead trolley 130 and catch member 50 catches latch pin 134, latch pin 134 exerts force on catch member 50 and pushes shaft 63 in the direction of the exerted force. Pin member 62 extends through shaft 63. Pin member 62 defines opposite ends 62' extending from shaft 63, and abutting resilient biasing member 61. In this way, movement of shaft 63 causes pin member 62 to compress resilient biasing member 61. Consequently, resilient biasing member 61 expands to apply a counter-force against pin member 62. These two competing forces cause latch mechanism 40 to lock into place about latch pin 134.

In one embodiment, resilient biasing member 61 is a compression spring. The strength of the spring can be calibrated to hold catch member 50 against latch pin 134 until a pre-determined counter force is applied to latch mechanism 40 to overcome the counter tension and swing lead operable wall panel 14 open. Resilient biasing member 61 should exert sufficient force against pin member 62 to maintain catch member 50 about latch pin 134. In another embodiment, resilient biasing member 61 is any elastic member which exerts a resistant force against pin member 62 to maintain catch member 50 about latch pin 134 when its shape is deformed. In still another embodiment, resilient biasing member 61 is a pneumatic shock. In yet another embodiment, resilient biasing member 61 is a strut.

FIG. 5 illustrates the placement of latch mechanism 40 in latch assembly system 140 according to one embodiment of the present invention. Latch mechanism 40 is attached adjacent to a forward end of top edge 84 of lead operable wall panel 14. The term "forward end" refers to the end of top edge 84 of lead operable wall panel 14 which is closest to front edge 85 of lead operable wall panel 14. In another embodiment, latch mechanism 40 is attached adjacent to the top right-most corner of front side 15 (shown in FIG. 1) of lead operable wall panel 14. In yet another embodiment, latch mechanism 40 is attached adjacent to the top of front edge 85 (shown in FIG. 1) of lead operable wall panel 14. The term "top" refers to any area of lead operable wall panel 14 which is closer to top edge 84 than it is from bottom edge 94 of lead operable wall panel 14. In one embodiment, latch assembly 40 is mounted on mounting plate 43, which is mounted adjacent to a forward end of top edge 84 of lead operable wall panel 14.

Lead trolley 130 includes pivot member 35 that is pivotally coupled to lead trolley 130 at one end and is attached at the opposite end to lead operable wall panel 14 at mount 16. Mount 16 is fixed adjacent to top edge 84 of lead operable wall panel 14. The pivotal coupling of pivot member 35 to lead trolley 130 allows lead operable wall panel 14 to pivotally rotate about pivot member 35. Chain drive 37 (shown in FIG. 3) is attached to trolley 30 and lead trolley 130. As chain drive 37 pulls trolley 30 and lead trolley 130, the longitudinal force of chain drive 37 forces rotating discs 31,32 down, keeping latch pin 134 in place. "Longitudinal force" as used herein refers to the force moving in the direction of trolley 30 and lead trolley 130. The pivotal movement of lead operable wall panel 14 causes latch pin 134 to pivot into latch mechanism 40 as lead operable wall panel 14 unfolds from its stacked orientation to its straightened orientation and aligns with lead trolley 130. In one particular embodiment of the present invention, lead trolley 130 has six (6) rotating discs. Guide block 42 is mounted to a forward end of base member 43. The term "forward end" refers to the end of base member 43 where catch member 50 rests when it is not engaging latch pin 134. Guide block 42 positions lead operable wall panel 14 against an internal flattener (not shown). The internal flattener is the subject of a co-pending application, entitled "Flattener Apparatus for a Movable Wall System," submitted by applicants Tom Goldsmith, Steve Helbing, and Jeff Kronlage and is hereby incorporated by reference into this Application.

Figure 8:
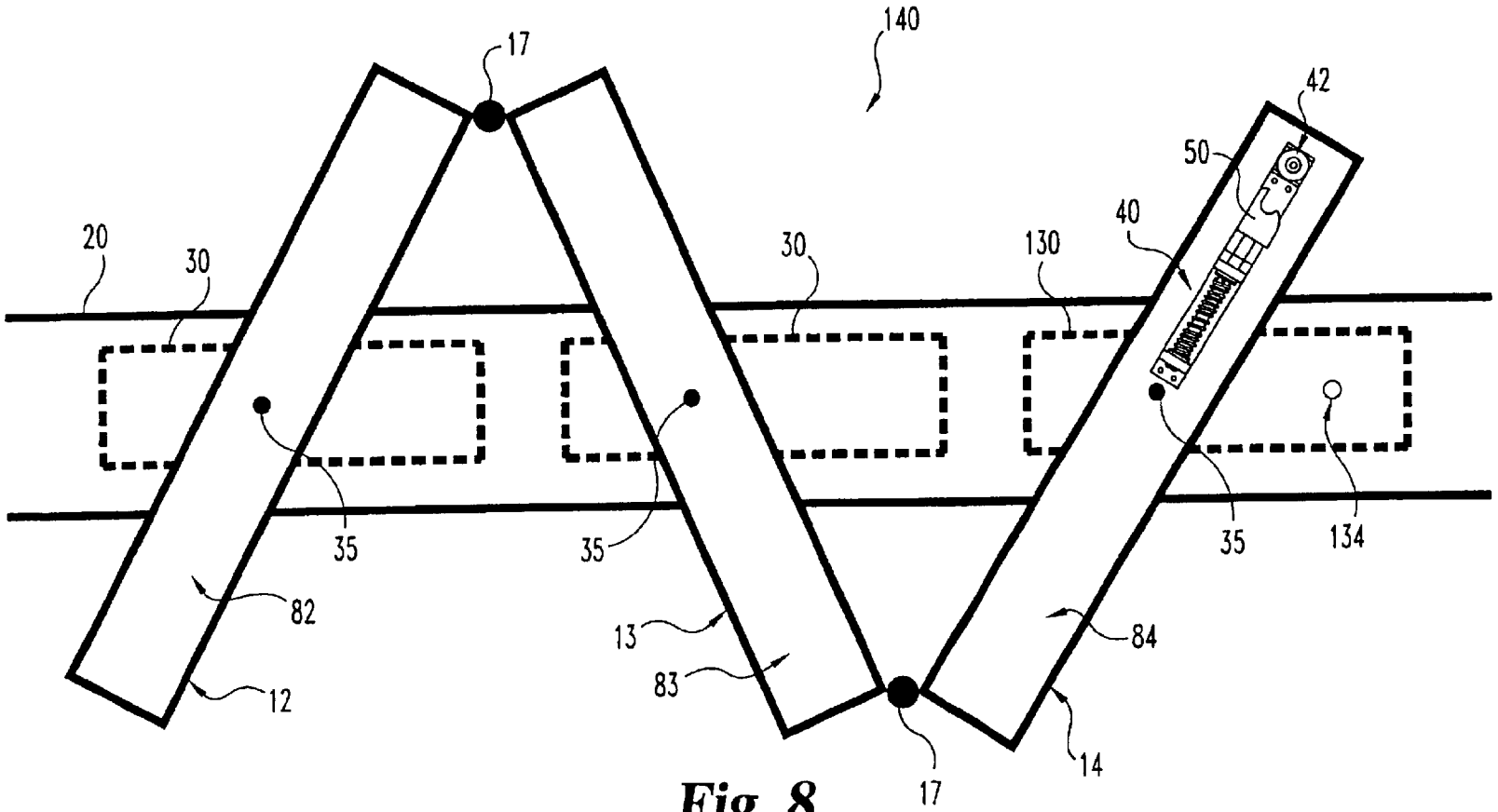
FIG. 8 is a top diagrammatic view of a track and trolley system incorporating the latch assembly system of the present invention when the operable wall panels are extending to their straightened orientation.
Figure 9:
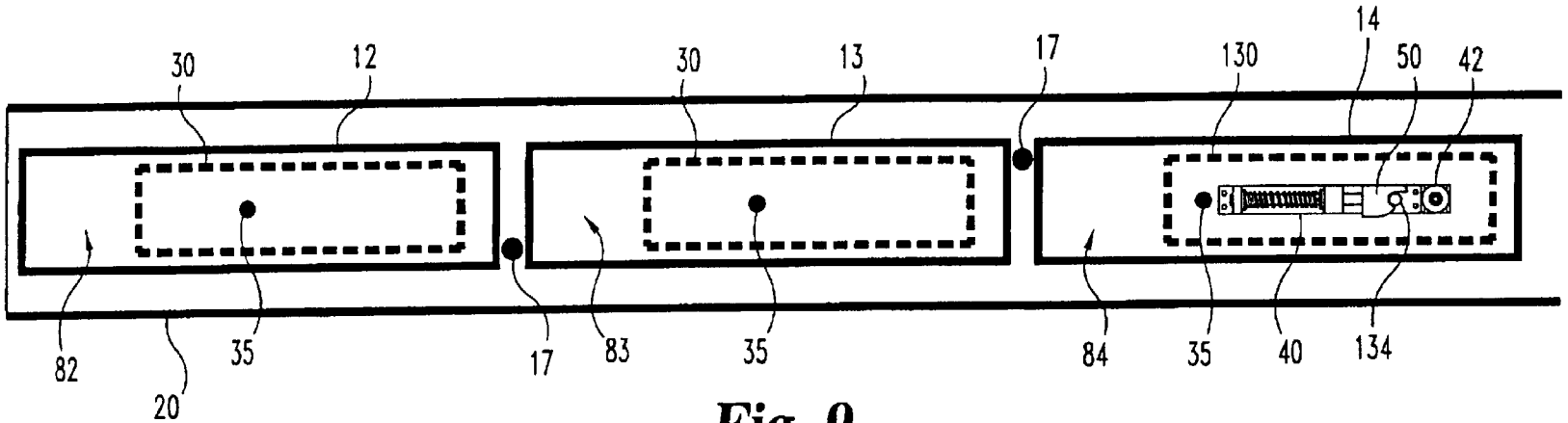
FIG. 9 is a top diagrammatic view of a track and trolley system incorporating the latch assembly system of the present invention when the operable wall panels are in their straightened orientation.

Latch mechanism 40 is displayed in FIG. 8 as part of latch assembly system 140 (shown in FIG. 5) of the present invention. The extending of continuously-hinged panels 12, 13 and lead operable wall panel 14 along track 20 is shown. As continuously-hinged panels 12, 13 and lead operable wall panel 14 extend, lead operable wall panel 14 pivots about pivot member 35 of lead trolley 130. As shown in FIG. 9, when lead operable wall panel 14 swings open, catch member 50 of latch mechanism 40 catches latch pin 134 and locks lead operable wall panel 14 in a straight position. After lead operable wall panel 14 locks into place, continuously-hinged panels 12, 13 and lead operable wall panel 14 extend to their straightened, wall-forming orientation.

In other embodiments of the present invention, the latch mechanism is attached to a top edge of a panel that is not the lead panel.

While the invention has been illustrated and described in detail in the drawings and foregoing description, the same is to be considered as illustrative and not restrictive in character. It should be understood that only exemplary embodiments have been shown and described and that all changes and modifications that come within the spirit of the invention are desired to be protected.

What is claimed is:

1. A latch assembly system for aligning an operable wall panel with a trolley of a track and trolley system, the latch assembly system comprising:

a latch pin adapted to be attached adjacent to a forward end of the trolley and depending down therefrom; and a latch mechanism adapted to be attached adjacent to a top edge of the operable wall panel, said latch mechanism comprising:

a base member mountable on the top edge of the operable wall panel, and a catch member supported by said base member, said catch member slidable on said base member, and configured to slidably and resiliently engage said latch pin depending down from the trolley.

2. The latch assembly system of claim 1 wherein said latch mechanism further comprises:

first and second bracket members mounted to said base member;

an elongated shaft connected to said catch member, extending through said first and second bracket members;

a resilient biasing member for biasing said catch member against said latch pin, said resilient biasing member supported along an outer surface of said elongated shaft; and a pin member extending through said shaft for biasing said resilient biasing member.

3. The latch assembly of claim 2 wherein said resilient biasing member includes a spring.

4. The latch assembly of claim 2 wherein said catch member defines:

a cam surface which is adapted to engage said latch pin to lock said latch mechanism into alignment with the trolley;

a stop face for stopping the engagement of said latch pin; and a latch pin seat for maintaining said latch pin within said catch member.

5. A latch assembly system in combination with a track and trolley system, the combination comprising:

a track;

a trolley movable along said track, said trolley including a latch pin attached adjacent to a forward end of said trolley and depending down therefrom, said trolley further including a pivot member pivotally coupled at one end thereof to said trolley and depending down therefrom;

an operable wall panel having a top edge, said pivot member being attached to said operable wall panel; said operable wall panel being carried by said trolley; and a latch mechanism attached to said operable wall panel, said latch mechanism comprising:

a base member mountable on the top edge of the operable wall panel, and a catch member slidable on said base member, and configured to slidably and resiliently engage said latch pin depending down from the trolley.

6. The combination of claim 5 wherein said latch mechanism comprises:

first and second bracket members mounted to said base member;

an elongated shaft connected to said catch member, extending through said first and second bracket members;

a resilient biasing member for biasing said catch member against said latch pin, said resilient biasing member supported along an outer surface of said elongated shaft; and a pin member extending through said shaft for biasing said resilient biasing member.

7. The combination of claim 6 wherein said resilient biasing member includes a spring.

8. The combination of claim 6 wherein said catch member defines:

a cam surface which is adapted to engage said latch pin to lock said latch mechanism into alignment with the trolley;

a stop face for stopping the engagement of said latch pin; and a latch pin seat for maintaining said latch pin within said catch member.

9. The combination of claim 5 wherein said top edge of said operable wall panel includes a mounting plate, said mounting plate attached adjacent to said top edge of said operable wall panel, said base member mountable on said mounting plate.

10. A method of aligning an operable wall panel with the track of a track and trolley system, the method comprising the steps of:

providing a track;

providing a trolley movably coupled to said track, said trolley having a latch pin depending down therefrom;

providing an operable wall panel pivotally coupled to the trolley, said operable wall panel having a top edge;

securing said top edge to said trolley;

providing a latch mechanism attached to the operable wall panel, said latch mechanism having a catch member configured to slidably and resiliently engage said latch pin; and pivotally moving said operable wall panel with respect to said trolley, whereby said catch member slidably and resiliently engages said latch pin, and whereby said latch mechanism maintains alignment between said operable wall panel and said track.

* * * * *